US005136937A

United States Patent [19]

Nogawa

[11] Patent Number: 5,136,937

[45] Date of Patent: Aug. 11, 1992

[54] PRINTING DEVICE

[75] Inventor: Bungo Nogawa, Yokohama, Japan

[73] Assignee: Amano Corporation, Yokohama, Japan

[21] Appl. No.: 752,012

[22] Filed: Aug. 29, 1991

[30] Foreign Application Priority Data

Aug. 31, 1990 [JP] Japan ..... 2-91398[U]

[51] Int. Cl.[5] ..... B41J 45/00

[52] U.S. Cl. ..... 101/72; 101/287; 101/316; 400/56; 400/58; 34/82; 34/87

[58] Field of Search ..... 101/72, 57, 68-69, 101/70, 287, 316, 78, 93, 96; 400/56, 57, 58; 346/78, 80, 82, 87, 89

[56] References Cited

U.S. PATENT DOCUMENTS

| | | | |
|---|---|---|---|
| 2,087,315 | 7/1937 | Bugg et al. | 346/89 |
| 2,214,796 | 4/1940 | Ostler | 346/89 |
| 2,796,315 | 6/1957 | Moodie | 346/82 |
| 3,039,103 | 6/1962 | Bud | 346/87 |
| 3,693,543 | 9/1972 | Noller | 101/316 |
| 4,415,801 | 11/1983 | Franke | 101/72 |
| 4,494,127 | 1/1985 | King | 346/82 |
| 4,632,577 | 12/1986 | Brull et al. | 400/58 |
| 4,655,625 | 4/1987 | Brull | 400/58 |
| 4,706,527 | 1/1989 | Erwin | 101/287 |
| 4,810,110 | 3/1989 | Myers | 400/58 |

FOREIGN PATENT DOCUMENTS

| | | | |
|---|---|---|---|
| 8504840 | 11/1985 | European Pat. Off. | 400/57 |
| 0195981 | 10/1986 | European Pat. Off. | 400/58 |
| 3423195 | 1/1986 | Fed. Rep. of Germany | 400/56 |
| 0203072 | 11/1983 | Japan | 400/58 |
| 2033841 | 5/1980 | United Kingdom | 101/287 |

OTHER PUBLICATIONS

"Low-Cost Single-Line Printer", IBM Tech. Discl. Bulletin, vol. 27, No. 1B, Jun. 84, pp. 637-638.

*Primary Examiner*—Eugene H. Eickholt

*Attorney, Agent, or Firm*—Wenderoth, Lind & Ponack

[57] ABSTRACT

A frame plate is movably mounted on a guide shaft erected from a base for movement upward and downward, a space formed between the base and the frame plate being served as the insertion passage for the typing sheet. The frame plate is provided thereon with a printer adapted to print such data as time and serial numbers on the inserted typing sheet, a cam shaft adapted to move the printer forward and backward, and a motor for rotating the cam shaft. A spring is disposed between the frame plate and the base in order to normally pull the frame plate toward the base side, a rubber stopper being disposed to a bottom surface of the frame plate in order to normally maintain the distance between a printer head and the surface of the typing sheet constant. The cam shaft is provided on one end thereof with a cam disc which, while pressing a cam face thereof against a supporting roller disposed on the base side, is rotated to push the whole frame plate upward against a pull-force of the spring to spread the space of the insertion passage when the printer is moved forward toward a typing start position by the cam shaft, and which release the pushing-up action exerted to the frame plate in order to lower the frame plate toward the base side when the printer, while maintaining its typing action, is moved backward toward the start position.

1 Claim, 6 Drawing Sheets

PRINTING DEVICE

BACKGROUND OF THE INVENTION

1. Field of the Invention

This invention relates to an improvement of a printing device so-called "side printer" for typing data of time, serial numbers (numbering), etc. on a side portion of an inserted typing sheet (typing card) along its inserting direction.

2. Brief Description of the Prior Art

The conventional printing device so-called "side printer" adopts a method for typing time, serial numbers, etc. on a typing sheet inserted into a space between a type wheel and a hammer.

However, the conventional printing device of the type mentioned above had the following shortcomings. Since the typing is effected bt the hammer, the typing sound is large, and since the type wheel is specified to the one mounted, one printing device cannot be used for both time and serial number typing, for example, and the type wheel must be changed each time when the types are required to be changed. This is very inconvenient, indeed, in practical use. Therefore, in order to obviate the above shortcomings, a different type of printer such as dot printer is used as typing means instead of the type wheel in recent time.

Although the above-mentioned printer has such diversity as that the typing sound is small compared with a printing device using a type wheel and simply by changing the typing mode, one printing device can easily be changed to a machine having both time and serial number typing functions. However, a typing machine using this printer has the following shortcomings. If the distance between the printer head and the typing sheet is not maintained normally constant, since the typing pressure is changed with the result that the printed characters are uneven in shade, it is required to use only a typing sheet having a predetermined thickness or otherwise it is required for such printing device to have means for adjusting the distance so that the distance can be adjusted depending on the thickness of a typing sheet to be used before typing. Since the typing sheet to be used is limited, the printing device lacks wide use. In addition, operation is complicated and troublesome.

The present invention has been accomplished in order to obviate the above-mentioned shortcomings.

SUMMARY OF THE INVENTION

It is thereof an object of the present invention to provide a printing device, in which a typing sheet having any thickness can be used, and such data as time and serial numbers can be printed in uniform shade simply by inserting a typing sheet and without requiring such troublesome operation as adjusting the thickness of a typing sheet.

In order to achieve the above object, the present invention provides a printing device in which upon insertion of a typing sheet into an insertion passage, a printer is actuated to print such data as time and serial numbers (numbering) on a side portion of the typing sheet, the improvement including the following component elements:

(1) a frame plate is movably mounted on a guide shaft erected from a base for movement upward and downward, and a space formed between the base and the frame plate is served as the insertion passage for the typing sheet;

(2) the frame plate is provided thereon with a printer adapted to print such data as time, numbering, etc. on the inserted typing sheet, a cam shaft adapted to move the printer forward and backward, and a motor for rotating the cam shaft;

(3) a spring is disposed between the frame plate and the base in order to normally pull the frame plate toward the base side, a rubber stopper being disposed to a bottom surface of the frame plate in order to normally maintain the distance between a printer head and the surface of the typing sheet constant; and (4) the cam shaft is provided on one end thereof with cam disc which, while pressing a cam face thereof against a supporting roller disposed on the base side, is rotated to push the whole frame plate upward against a pull-force of the spring to spread the space of the insertion passage when the printer is moved forward toward a typing start position by the cam shaft, and which releases the pushing-up action exerted to the frame plate in order to lower the frame plate toward the base side when the printer, while maintaining its typing action, is moved backward toward the start position.

The respective component elements (1) through (4) exhibit the following functions.

① The component element (1) makes it possible to adjust the space of the insertion passage by moving the frame plate upward and downward along the guide shaft, thus enabling to insert a typing sheet having any thickness.

② The component element (2) makes it possible to print such data as time and numbering using only one printer acting as the typing means. Furthermore, the element (2) makes it possible that since a typing unit comprising the printer, the cam shaft for moving the printer and the motor for rotating the cam shaft is mounted on the frame plate, the unit can move upward and downward along the guide shaft together with the frame plate.

③ The function of the component element (3) is as follows. The printer head can be set normally in a typing position by the pulling force of the spring which acts on the frame plate in such a manner as to pull it downward. On the other hand, the frame plate pulled down by the spring makes it possible to print such data as time and numbering in uniform shade because the distance between the printer head and the typing surface can be normally maintained constant irrespective of the thickness of the inserted typing sheet and the printer head, i.e. the distance between the printer head and the typing surface can be maintained constant by the rubber stopper.

④ By virtue of the component element (4), when the printer is moved forward toward the typing start position, since the cam disc pushes up the whole frame plate against the pull force of the spring to spread the distance between the printer head and the inserted typing sheet, the printer head (typing ribbon) can be prevented from contacting the typing sheet. On the other hand, when the printer is moved backward while maintaining its typing action, since the pushing-up action is released to permit the frame plate to be lowered by the pull force of the spring and the rubber stopper presses the surface of the typing sheet to maintain a predetermined distance, there can be obtained a clear typing under a predetermined typing pressure.

BRIEF DESCRIPTION OF THE DRAWINGS

The novel features believed characteristic of the present invention are set forth in the appended claims. The invention itself, however, as well as a preferred mode of use, further objects and advantages thereof will best be understood by reference to the following detailed description of an illustrative embodiment when read in conjunction with the accompanying drawings, wherein:

DETAILED DESCRIPTION OF THE EMBODIMENT

One preferred embodiment of a printing device according to the present invention will be described in detail with reference to the accompanying drawings.

Figure 1:
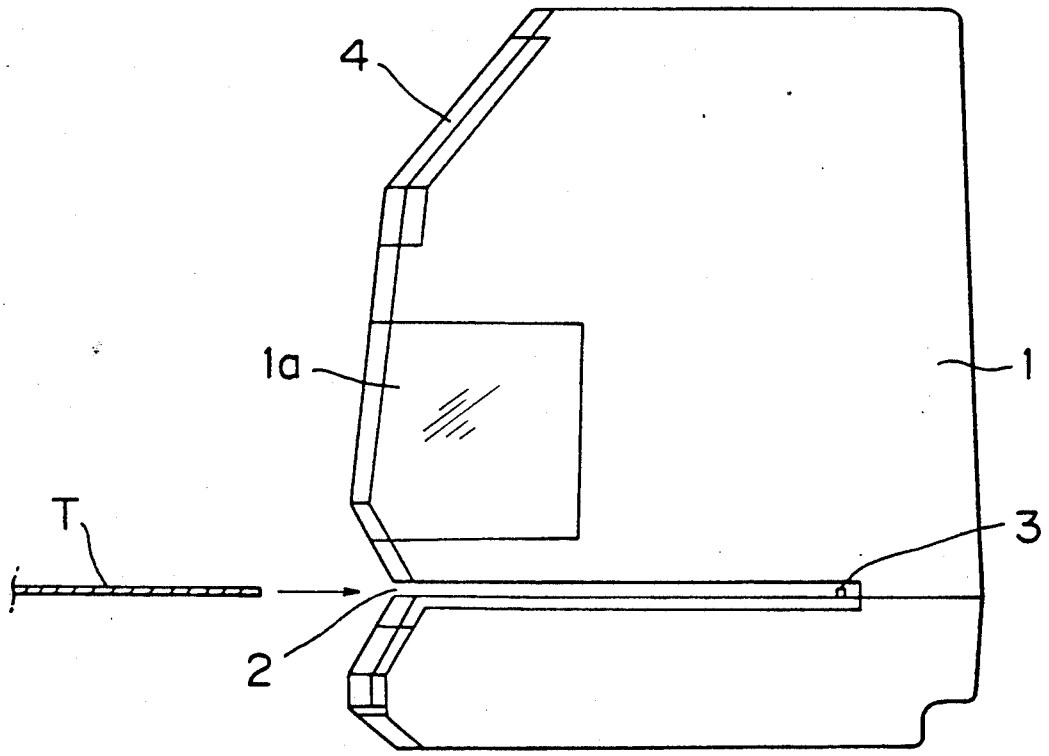
FIG. 1 is a side view showing the appearance of a printing device according to the present invention.
Figure 2:
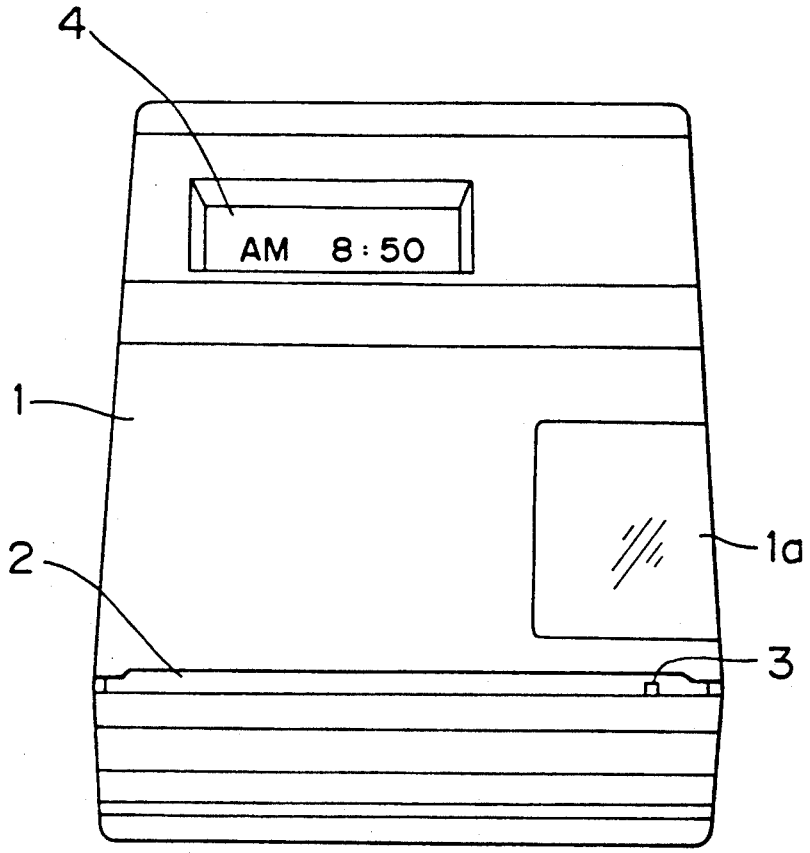
FIG. 2 is a front view thereof.

FIG. 1 is a side view of a printing device (side printer) according to the present invention, and FIG. 2 is a front view thereof. In FIGS. 1 and 2, the reference numeral 1 denotes a body of the printing device, 2 an insertion mouth for a typing sheet T, 3 a switch for a typing motor (which will be described later), which is turned on pushed by the inserted typing sheet T, 4 a display portion for displaying date and time, and 1*a* an inspection window formed in a part of the body 1.

Figure 3:
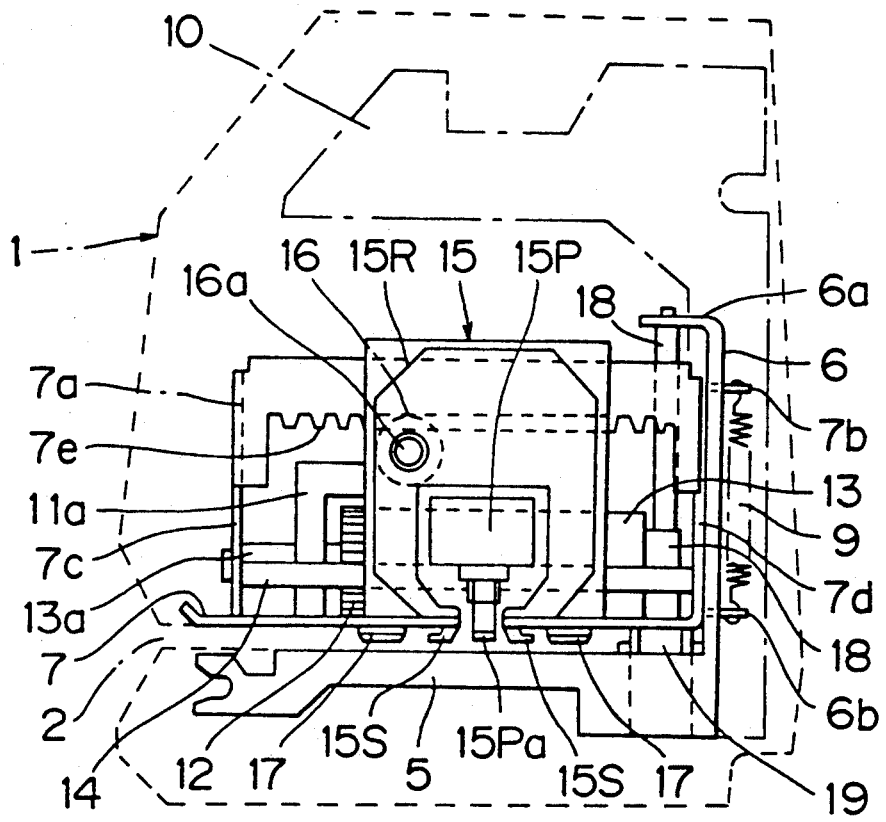
FIG. 3 is a side view showing the internal structure of the printing device of the present invention.
Figure 4:
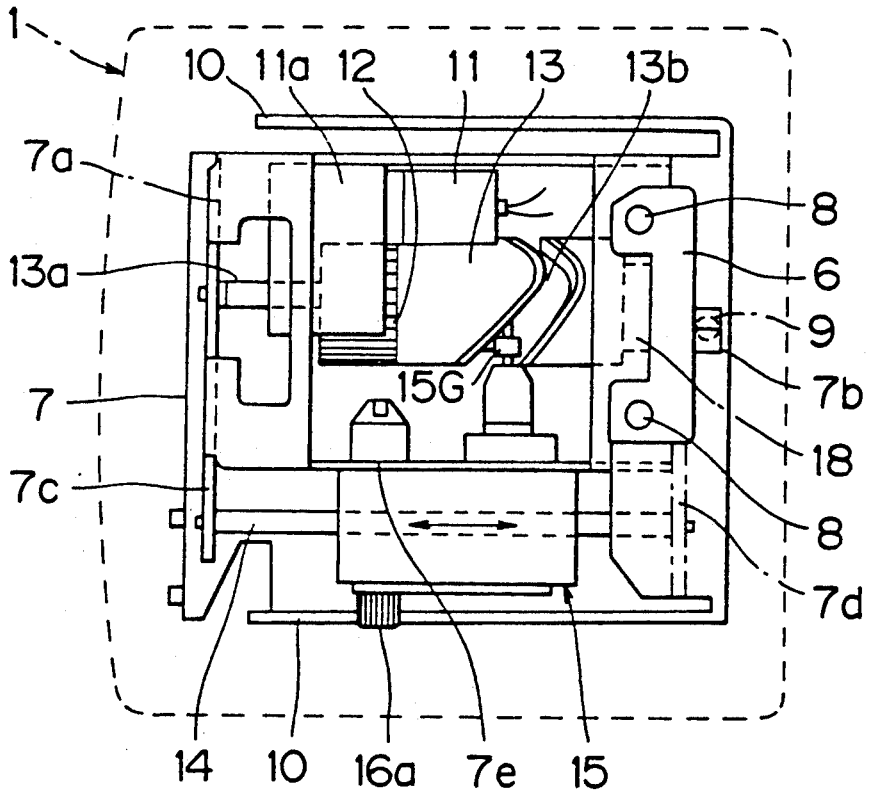
FIG. 4 is a plan view thereof.

FIG. 3 is a side view showing the internal structure of the printing device and FIG. 4 is a plan view thereof. In FIGS. 3 and 4, the reference numeral 5 denotes a base fixed to a bottom portion within the body 1, and 6 a supporting frame erected on a rear surface portion of the base 5, guide shafts 8, 8 erected on both sides of the base 5 being supported at upper end portions thereof by a supporting piece 6*a* of the supporting frame 6 which is bent inwardly at right angles.

Next, the reference numeral 7 denotes a frame plate supported by guide shafts 8, 8 in a cantilever fashion and movable upward and downward relative to the base 5. The reference numerals 7*a* and 7*d* denote a front and rear plates of the frame plate 7, respectively. A spring 9 adapted to normally pull down the whole frame plate 7 toward the base 5 side is disposed between a mounting piece 7*b* projecting from an upper portion of the rear plate 7*d* and a mounting piece 6*b* projecting from a lower side of the supporting frame 6.

The reference numerals 10, 10 respectively denote mounting plates for mounting various members connected to the base 5, 11 a typing motor mounted on the frame plate 7 in such a manner as to be integral with a reduction gear 11*a*, 12 a gear which is driven for rotation by the typing motor 11, 13 a cam shaft integrally connected with the gear 12, 13*a* a mounting shaft for rotatably mounting the gear 12 and the cam shaft 13 on the frame plate 7, and 13*b* a cam groove formed in the peripheral surface of the cam shaft 13 and adapted for the use of moving the printer.

Next, the reference numeral 14 denotes a guide shaft disposed between the front and rear plates 7*a* and 7*b* across the frame plate 7, and 15 a framework movably mounted on the guide shaft 14, and 15R and 15P respectively denote a typing ribbon case and a printer (dot printer) which are mounted within the framework 15. Similarly, the reference numeral 15G denotes a guide roller projecting from a rear surface portion of the framework 15, the guide roller 15G being engaged in the cam groove 13*b* of the cam shaft 13 in order to move the framework 15 with the printer 15G and typing ribbon case 15R mounted thereon forward and backward along the guide shaft 14 in accordance with a full rotation of the cam shaft 13. When the framework 15 with the printer 15G and typing ribbon case 15R mounted thereon is moved backward, in other words, when the framework 15 is moved in the right-hand direction in FIG. 6, time data, serial numbers, etc. are printed on the inserted typing sheet T by the printer 15P.

The reference numeral 17*e* denotes a rack mounted on the frame plate 7. The rack 17*e* is meshed with a ribbon feed gear 16 of the typing ribbon case 15R, so that when the framework 15 is moved forward toward the typing start position by the cam shaft 13, in other words, when the framework 15 is moved in the left-hand direction in FIG. 3, the typing ribbon is fed by the function of a one-way clutch (not shown), and, on the contrary, when the framework 15 is moved in the right-hand direction in the drawing, the typing ribbon is not fed. The reference numeral 16*a* denotes a gear feed handle.

The reference numerals 15S and 15S respectively denote guide stoppers projecting from a bottom surface of the framework 15, while 17 and 17 respectively denote rubber stoppers disposed on a bottom surface of the frame plate 7. The stoppers 15S and 17 press the upper surface of the inserted typing sheet T during the typing operation of the printer 15P in order to normally maintain the distance between the printer head 15P*a* and the surface of the typing sheet constant.

On the other hand, the reference numeral 18 denotes a disc cam projecting from one end face of the cam shaft 13. The peripheral surface of the cam disc 18, which is rotated integrally together with the cam shaft 13, is normally pressed against the peripheral surface of the supporting roller 9 disposed on the base 5 side both by the pulling function of the spring 9 and the dead weight of the frame plate 7, so that the frame plate 7 is moved upward and downward relative to the base 5 in accordance with the rotation.

Figure 5:
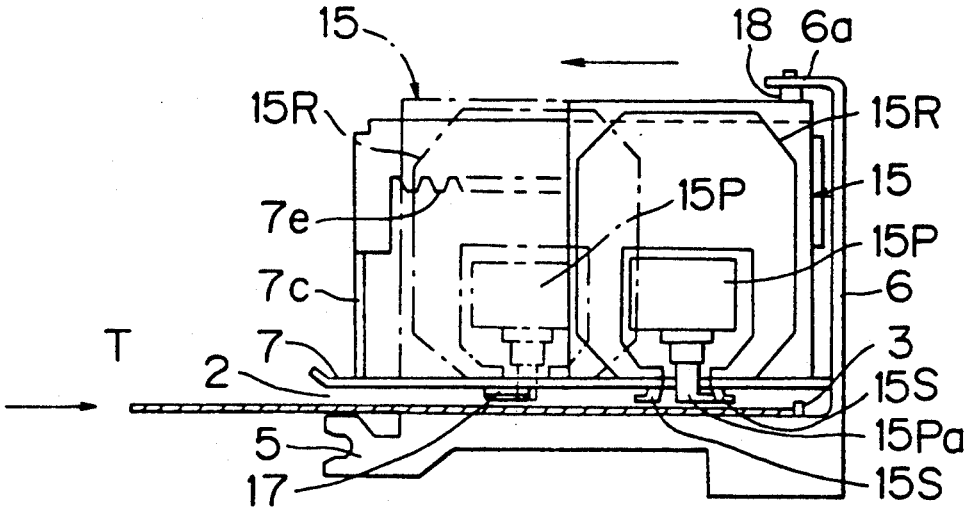
FIG. 5 is a side view showing a state where a printer is moved forward.
Figure 6:
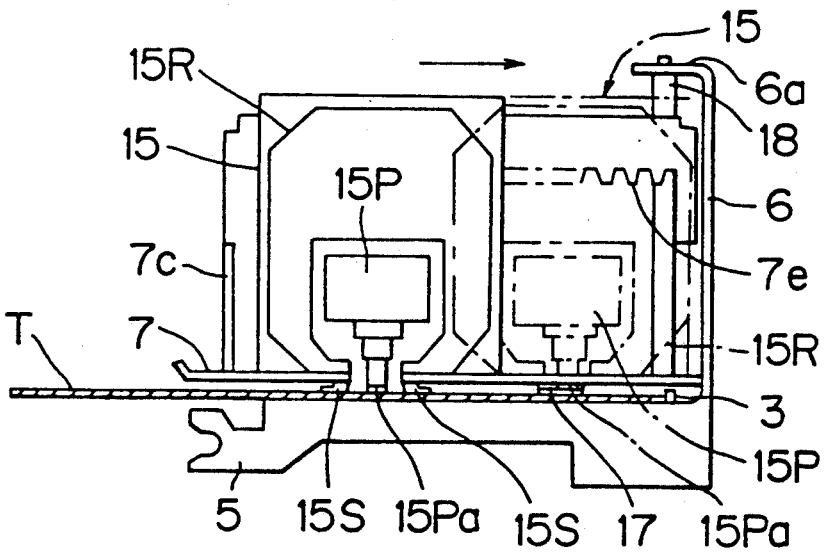
FIG. 6 is likewise a side view showing a state where the printer is moved backward.
Figure 7:
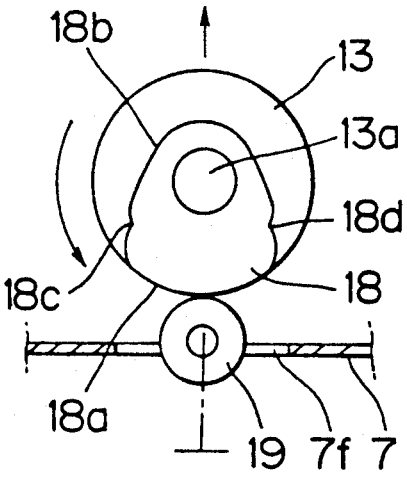
FIG. 7 is a schematic view for explaining a state where a whole frame plate is pushed up by a cam disc.
Figure 8:
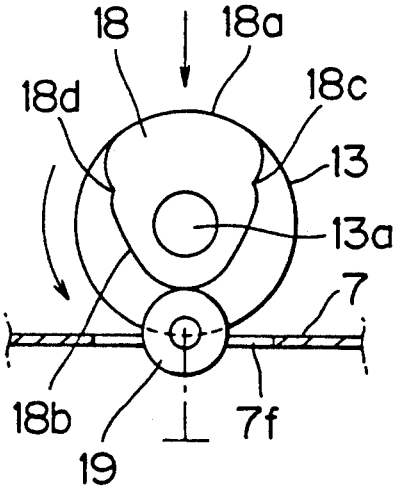
FIG. 8 is likewise a schematic view for explaining a state where the pushing-up action made by the cam disc is released.

More specifically, in FIGS. 7 and 8, the reference numerals 18*a* and 18*b* respectively denote large and small diameter portions of the cam disc 18, while the reference numerals 18*c* and 18*d* respectively denote a typing start position portion and a start position portion which are formed between the large and small diameter portions 18*a* and 18*b*. When the printer 15P is moved forward toward the typing start position in accordance with the rotation of the cam shaft as shown in FIG. 5, the whole frame plate 7 is pushed up by the large diameter portion 18*a* disposed between the start position portion 18*d* of the cam disc 18 and the typing start portion 18*c* as shown in FIG. 7 in order to spread the distance between the plate 7 and the base 5, i.e., the space of the insertion mouth 2 as shown in FIG. 5. On the other hand, when the printer is moved backward toward the start position likewise in accordance with the rotation of the cam shaft 13 as shown in FIG. 6, since the small diameter portion 18*b* of the cam disc 8 is brought into contact with the supporting roller 19 to release the pushing-up action as shown in FIG. 8, the whole frame plate 7 is likewise lowered to bring the printer head 15P*a* into a close vicinity of the typing surface of the inserted typing sheet T as shown in FIG. 6, so that the printer 15P can start typing.

In FIGS. 7 and 8, the reference numeral 7*f* denotes an insertion hole for the supporting roller 19, which is formed in the frame plate 7.

Since the constitution of a printing device according to the present invention is such as mentioned above, when the switch 3 is turned on after the typing sheet T is inserted into the insertion mouth 2 as shown in FIG. 5, the motor 11 is actuated to rotate the cam shaft 13 counterclockwise in FIGS. 7 and 8, and in the state the frame plate 7 is pushed up from the base 5 by the cam disc 18 likewise as shown in FIG. 5, the framework 15 with the printer 15P and the typing ribbon case 15R mounted thereon is moved forward in the left-hand direction in the drawings toward the typing start position.

Then, when the framework 15 is moved backward in the right-hand direction in FIG. 6 in accordance with the rotation of the cam shaft 13, the pushing-up action made by the cam disc 18 is released to permit the whole frame plate 7 to be lowered both by the pull-force of the spring 9 and dead weight thereof until the rubber stopper 17 is brought into contact with the surface of the typing sheet. As a result, the typing made by the printer 15P can be effected in uniform shade with a certain typing pressure and clearance.

The printer 15P, which has been moved forward and backward together with the framework 15 in accordance with a full rotation of the cam shaft 13 as mentioned above, is stopped movement in a position where the whole frame plate 7 is slightly pushed up by a full rotation of the cam disc 18, so that the typing sheet T on which typing is already made can be removed and a new typing sheet T can be inserted.

As described in the foregoing, according to a printing device of the present invention, when the printer is moved forward toward the typing start position from the start position upon insertion of a typing sheet, the whole frame plate with the printer mounted thereon is pushed up by the cam disc in order to spread the distance between the printer head and the typing sheet. On the contrary, when the printer is moved backward toward the start position from the typing start position, the whole frame plate is lowered to bring the printer head into the close vicinity of the surface of the typing sheet and the distance between the printer head and the surface of the typing sheet is maintained constant by the rubber stopper to thereby maintain the typing pressure constant. Accordingly, there can be effected a clear typing in uniform shade on a typing sheet having any thickness normally under a predetermined pressure. Therefore, the present invention can suitably applied to various kinds of typing machine or printing machine such as time stamp, time recorder, etc.

Although the present invention has been described with reference to a specific embodiment, this description is not meant to be construed in a limiting sense. Various modifications of the disclosed embodiment as well as alternative embodiments of the present invention will become apparent to those skilled in the art upon reference to the description of the invention. It is therefore contemplated that the appended claims will cover any such modifications or embodiments that fall within the true scope of the present invention.

What is claimed is:

1. A printing device in which upon insertion of a typing sheet into an insertion passage, a printer is actuated to print such data as time and serial numbers on a side portion of the typing sheet, the improvement comprising:

a frame plate is movably mounted on a guide shaft erected from a base for movement upward and downward, a space formed between said base and said frame plate being served as said insertion passage for the typing sheet;

said frame being provided thereon with a printer adapted to print such data as time and serial numbers on the inserted typing sheet, a cam shaft adapted to move said printer forward and backward, and a motor for rotating said cam shaft;

a spring disposed between said frame plate and said base in order to normally pull said frame plate toward said base side, a rubber stopper being disposed to a bottom surface of said frame plate in order to normally maintain the distance between a printer head and the surface of the typing sheet constant; and said cam shaft being provided on one end thereof with a cam disc which, while pressing a cam face thereof against a supporting roller disposed on said base side, is rotated to push said whole frame plate upward against a pull-force of said spring to spread the space of said insertion passage when said printer is moved forward toward a typing start position by said cam shaft, and which releases the pushing-up action exerted to said frame plate in order to lower said frame plate toward said base side when said printer, while maintaining its typing action, is moved backward toward the start position..

* * * * *